US006872413B2

(12) United States Patent
Rosenblum

(10) Patent No.: US 6,872,413 B2
(45) Date of Patent: Mar. 29, 2005

(54) METHOD OF PACKING AND SHIPPING PICKLES

(75) Inventor: William Rosenblum, Wyckoff, NJ (US)

(73) Assignee: Sunshine Fresh Inc., Totowa, NJ (US)

( * ) Notice: Subject to any disclaimer, the term of this patent is extended or adjusted under 35 U.S.C. 154(b) by 0 days.

(21) Appl. No.: 09/792,482

(22) Filed: Feb. 23, 2001

(65) Prior Publication Data

US 2002/0119227 A1 Aug. 29, 2002

(51) Int. Cl.[7] ..... B65B 55/00

(52) U.S. Cl. ..... 426/324; 426/402; 426/411; 426/418; 426/506; 53/431; 53/477

(58) Field of Search ..... 426/411, 112, 426/324, 326, 402, 418, 131, 506, 654, 626; 53/428, 431, 477; 99/535

(56) References Cited

U.S. PATENT DOCUMENTS

| | | | | |
|---|---|---|---|---|
| 2,920,967 A | * | 1/1960 | Heinemann | 426/411 |
| 3,102,034 A | | 8/1963 | Weinberg | 99/171 |
| 3,255,019 A | | 6/1966 | Engelland | 99/156 |
| 4,121,400 A | | 10/1978 | Sohn et al. | 53/436 |
| 4,547,389 A | | 10/1985 | Palnitkar | 426/639 |
| 4,646,509 A | | 3/1987 | Tribert | 53/446 |
| 5,421,138 A | * | 6/1995 | Muise et al. | 53/440 |
| D399,705 S | | 10/1998 | Bovard et al. | D7/601 |
| 5,922,383 A | | 7/1999 | Cook et al. | 426/324 |
| 6,079,191 A | | 6/2000 | Borkiewicz et al. | 53/515 |

FOREIGN PATENT DOCUMENTS

JP 6-38676 A * 2/1994

* cited by examiner

*Primary Examiner*—Drew Becker
(74) *Attorney, Agent, or Firm*—Lerner, David, Littenberg, Krumholz & Mentlik, LLP

(57) ABSTRACT

Pickled products immersed in a pickling solution are packaged in a cardboard box for shipment to customers. The box is lined with a plastic bag to protect the pickled products and pickling solution from contaminants, and to prevent the pickling solution from leaking. The cardboard boxes may be arranged in multiple layers on a pallet for shipment. The pickled products may be put in the box in a pickled state or in a raw state, whereupon they cure to the pickled state during shipment.

17 Claims, 5 Drawing Sheets

METHOD OF PACKING AND SHIPPING PICKLES

BACKGROUND OF THE INVENTION

The present invention relates to methods of packing and shipping pickles, and, more particularly, to methods in which pickles may be packaged in bulk containers and shipped over large distances. Still more particularly, the present invention is directed to packing and shipping methods in which cucumbers may be pickled or cured in their shipping containers.

For many years, the manufacture and distribution of pickles in bulk has been, more or less, a regional business. The reasons for this largely relate to the manner in which the pickles are packaged and distributed. It has been customary practice that pickles sent directly to the end user, such as delis, restaurants, catering halls, etc, are packaged in bulk in ten-gallon plastic pails lined with a plastic bag. The pail is filled with cured pickles and a brine solution which prevents the pickles from drying out. Once filled, the top of the bag is ordinarily tied closed to hold the contents in place and to prevent contamination. The pails of pickles are then loaded on a truck and delivered to the end user.

The delivery of pickles in these ten-gallon pails has caused considerable problems for pickle manufacturers and distributors. Many of these problems stem from the common practice of filling each pail with cured pickles to a level above its upper rim. One problem this practice causes is that it prevents the pail from being closed with a tight-fitting lid. As a result, it has been possible to load only a single layer of filled pails on a truck for delivery at any one time. Any pails stacked on top of the first layer would be unsteady and would likely fall over as the delivery truck navigates its delivery route. Moreover, stacking any pails on top of the first layer of pails would damage the pickles in the first layer. Since it is impractical to load more than a single layer of pails of pickles in a truck for delivery, delivery costs for these pickles have been relatively high. Such high costs have made it uneconomical to make bulk deliveries of pickles in these pails beyond a local geographic area.

Another problem with the use of these ten-gallon pails is the relatively high cost of the pails themselves. In view of this high cost, pickle manufacturers typically charge their customers a deposit for each pail delivered. Although the customers ordinarily would have the deposit returned when they return the empty pail to the pickle manufacturer, the pails are frequently not returned. Rather, they are often conveniently put to a new use by the customer, such as for garbage, storing soups or sauces, storing other food products, etc. The failure of the customer to have their deposits for the pails returned raises the overall cost to the customer of the pickles.

The use of these plastic pails causes additional problems for pickle manufacturers. Firstly, while the pickles are ordinarily filled to a level above the upper rim of the pail, the brine solution can only be filled to the upper rim of the pail or lower. This causes the pickles in the topmost layer to dry out and lose their crispness. Also, the fact that the pails do not have a tight fitting lid, but rather are closed simply by tying the top of the inner bag, often results in the leakage and spillage of brine solution in the manufacturing plant and on the delivery trucks, as well as at the customer's establishment. Further, the pails require excessive handling since returned pails must be thoroughly cleaned before they may be reused. In addition, pickle manufacturers must maintain a costly inventory of these pails to replace those that are not returned or that become too damaged to be reused.

As an alternative to these large plastic pails, bulk pickles have been packaged in smaller five-gallon plastic tubs having a tight-fitting lid. In one such packaging arrangement, the tubs are filled with raw cucumbers and a brine solution, sealed closed, and shipped to a distributor or end user. During shipping, the cucumbers cure to a pickled state.

Although the curing of the cucumbers directly in their shipping tubs reduces handling by the manufacturer, the relatively high cost of the tubs themselves relative to the amount of pickles they are able to hold significantly increases the cost of the pickles to the customer. As a result, the use of these tubs has generally been limited to shipments over large distances. Moreover, when the empty tubs are thrown out, they occupy a relatively large volume, thereby incurring a high disposal cost to the customer.

A still further alternative for shipping pickles over a large distance has been to package them in small glass jars, with multiple glass jars packed in an outer cardboard case. These pickles are typically pasteurized before packaging to increase their shelf life, and therefore are not the fresh, bulk pickles desired by foodservice users. Moreover, the high packaging costs for the glass jars causes these pickles to be far too expensive for regular foodservice use. As a result, pickles in these containers are ordinarily sold through retail outlets.

There therefore exists a need for a container for delivering pickles in bulk which overcomes the problems associated with open top plastic pails. There further exists a need for a method which permits pickles to be shipped in bulk safely and economically over long distances.

SUMMARY OF THE INVENTION

The present invention addresses these needs.

One aspect of the present invention provides methods for manufacturing pickled products. According to these methods, a stock for pickling, such as cucumbers, is provided. Also provided is a cardboard box having a plurality of sides, a bottom and an open top. Preferably, the box is formed from a wax-impregnated cardboard so as to have a substantially rectangular profile. More preferably, the box has a volume sufficient to hold about ten gallons of the stock. The cardboard box has a liner with an open top, such as a plastic bag, and a selected quantity of the stock is placed in the liner. The liner may then be filled with a pickling solution, desirably, a brine solution, to a level which substantially covers the stock, after which the open top of the liner and the open top of the box may be closed. In a preferred arrangement in which the liner is a plastic bag, the open top of the bag may be closed by heat sealing, and the open top of the box may be closed by assembling a lid thereover. Once packaged as described, the stock cures to a pickled state. This curing may take place during the time the box is being shipped, or during storage either before or after shipping.

Desirably, a plurality of the boxes may be stacked on a pallet for shipping. The boxes may be stacked on the pallet so as to form at least two layers.

Another aspect of the present invention provides methods for packaging pickled products. According to these methods, a cardboard box is provided having a plurality of sides, a bottom and an open top. The box is lined, such as with a plastic bag having an open top, and a selected quantity of the pickled products is placed in the bag. The bag may then be filled with a liquid to a selected level, and both the open top of the bag and the open top of the box may be closed. In preferred methods, the liquid filled into the bag is a brine solution. Once packaged, the pickles may be shipped or conveniently stored for future shipment. During shipment or storage, a plurality of the boxes may be stacked on a pallet so as to form at least two layers on the pallet.

Pickles or other stock manufactured, packaged and shipped according to the foregoing methods provide many advantages over prior art manufacturing, packaging and shipping techniques. Firstly, the use of the cardboard boxes of the present invention enables a large number of units to be assembled in layers on a single pallet, thereby reducing overall shipping costs per unit of pickles and making it economical to ship bulk fresh pickles over large distances. Unit costs are further reduced by the relatively low cost of the cardboard boxes as used in the present invention as compared to the cost of the plastic pails and tubs presently in use. A still further advantage of the present invention is the relative ease of disposing of the cardboard boxes. Thus, not only may be the cardboard boxes be easily broken down so as to occupy a small disposal volume relative to the plastic pails and tubs, but they may be recycled, further reducing disposal costs. As a result of these and other advantages, fresh pickles may now be shipped in bulk more safely and economically, not only locally, but also over long distances.

BRIEF DESCRIPTION OF THE DRAWINGS

A more complete appreciation of the subject matter of the present invention and the various advantages thereof can be realized by reference to the following detailed description, in which reference is made to the accompanying drawings in which.

DETAILED DESCRIPTION

The methods of the present invention are described herein in connection with the pickling and shipping of cucumbers. However, it will be appreciated that the inventive aspects of these methods can readily be applied to processes in which other pickle stock is pickled in a brine or similar solution. In addition to cucumbers, such pickle stock may include fruits and vegetables such as green tomatoes, beets, cauliflower, pears and peaches. However, the pickling of cucumbers is the most prevalent.

The production of pickles from cucumbers in accordance with the present invention can generally be carried out using many of the conventional process steps known in the art. Generally, the process begins with whole, fresh cucumbers. The cucumbers as received by the pickle manufacturer may have been previously sorted by the supplier to fall within a certain size range. The cucumbers are then passed through a washing step to remove dirt and debris from their outer surfaces. If desired, the cucumbers may be further sized by the pickle manufacturer either before or after the washing step.

In one embodiment of the present invention, the washed cucumbers are then placed in a large barrel, covered with a pickling solution, typically a brine solution, and stored for a period of two weeks or more, during which time the cucumbers cure to a desired pickled state. Brine solutions for pickling cucumbers are well known in the art. Typical brine solutions may include, for example, water, salt, spices, garlic, and, optionally, a food preservative. It will be appreciated that brine solutions having different ingredients are contemplated herein, as are pickling compositions other than brine solutions.

Figure 4:
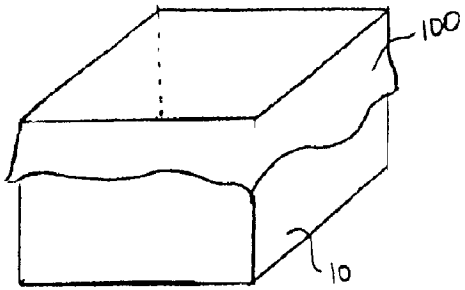
FIG. 4 is a perspective view of the box for packaging and shipping pickled products constructed from the blank of FIG. 1 and shown in an open and empty condition.

Once they have cured to a desired state, the pickles are packed in a box for shipment. A box 10 specifically designed for shipping the pickles is illustrated in FIG. 4. Box 10 is preferably constructed from a heavy duty corrugated cardboard so as to have sufficient strength to withstand the weight of the bulk pickles and brine solution held therein. Most preferred is a wax impregnated corrugated cardboard which can withstand moisture from the brine solution as the pickles are packed and subsequently used without a significant degradation in strength. Although box 10 may be formed with various dimensions to hold a desired volume of pickles, in a particularly preferred arrangement, box 10 is substantially rectangular and is dimensioned to hold about ten gallons of pickles. Thus, box 10 is a direct replacement for the ten gallon plastic pails conventionally used in the industry. A preferred arrangement to achieve this volume is to form box 10 with a length of about 15 inches, a width of about 12 inches and a height of about 13 inches.

Figure 1:
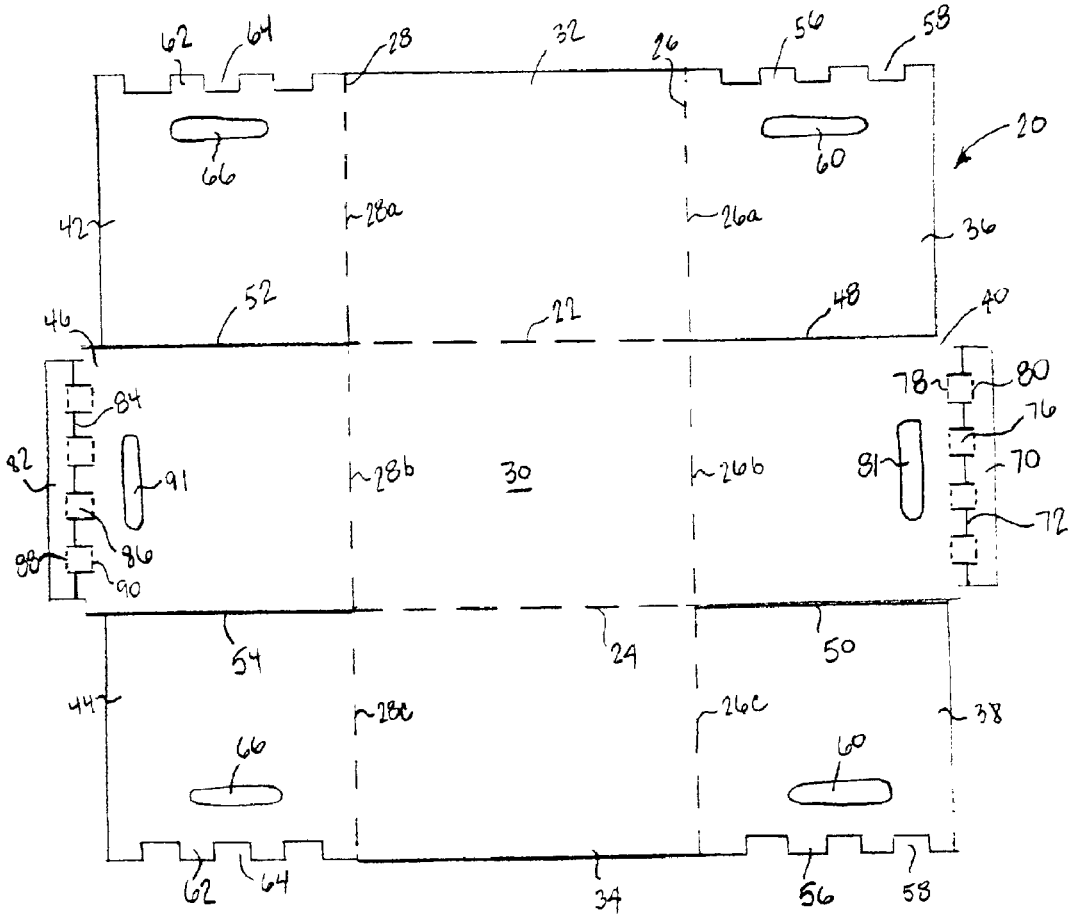
FIG. 1 is a plan view of a blank for forming a box for packaging and shipping pickled products in accordance with the present invention.

In accordance with techniques which are generally known in the art, box 10 may be formed from a single cardboard blank which, when folded according to a predetermined pattern, will yield a box of the desired size and shape. One such blank 20 is shown in FIG. 1. The broken lines depicted in FIG. 1 represent lines along which the blank is creased, embossed or otherwise weakened so as to be folded into the final box shape. The thickened full lines represent slits cut through the entire thickness of the cardboard.

Blank 20 is divided by longitudinal fold lines 22 and 24 and transverse fold lines 26 and 28 into bottom panel 30, side panels 32 and 34, and three overlying panels defining each end of the box, inner panels 36 and 38 and outer panel 40 defining one end of box 10, and inner panels 42 and 44 and outer panel 46 defining the opposite end of box 10. Slits 48 and 50 separate outer panel 40 from inner panels 36 and 38, respectively. Similarly, slits 52 and 54 separate outer panel 46 from inner panels 42 and 44, respectively. Inner panels 36 and 38 each include a series of alternating tabs 56 and recesses 58 formed along one edge thereof, and an elongated opening 60 oriented substantially perpendicular to fold line 26. Similarly, inner panels 42 and 44 are each formed with a series of tabs 62 and recesses 64 formed along one edge thereof, and an elongated opening 66 oriented substantially perpendicular to fold line 28.

Outer panel 40 includes a flap 70 foldably connected along one edge thereof. A series of H-shaped slits 72 in outer panel 40 and flap 70 define alternating openings 74 and strips 76 when flap 70 is folded relative to outer panel 40. A series of spaced folded lines 78 and 80 interconnect slits 72 to facilitate the folding of flap 70 relative to outer panel 40. Panel 40 also includes an elongated opening 81 oriented substantially parallel to fold line 26. Outer panel 46 includes the same structure. More particularly, outer panel 46 includes a flap 82 foldably connected along one edge, with a series of H-shaped slits 84 defining alternating openings (not shown) and strips 86 when flap 82 is folded relative to outer panel 46. Spaced fold lines 88 and 90 interconnect slits 84 to facilitate the folding of flap 82 relative to outer panel 46. An elongated opening 91 is formed in panel 46 and oriented substantially parallel to fold line 28.

In forming box 10, side panels 32 and 34 are bent upwardly along fold lines 22 and 24, respectively, until they are substantially perpendicular to bottom panel 30. Subsequently, inner panel 36 is folded inwardly along portion 26*a* of fold line 26 until it is substantially perpendicular to panel 32, and inner panel 38 is folded inwardly along portion 26*c* of fold line 26 until it is substantially perpendicular to side panel 34 and against inner panel 36. Outer panel 40 is then folded upwardly along portion 26*b* of fold line 26 so that inner panel 38 is sandwiched between inner end panel 36 and outer end panel 40. Panels 36, 38 and 40 are held in this assembled position by folding flap 70 over the aligned tabs 56 and recesses 58 of panels 36 and 38. In this folded condition, the aligned tabs 56 project through openings 74 and the strips 76 reside in the aligned recesses 58 to lock the end panels together. Also in this condition, openings 60 in panels 36 and 38 are in substantial alignment with opening 81 in panel 40 to define a hand hole for grasping one end of the box.

A similar procedure is used to form the other end of box 10. That is, inner panel 42 is folded inwardly along portion 28*a* of fold line 28 until it is substantially perpendicular to panel 32, and inner panel 44 is folded inwardly along portion 28*c* of fold line 28 until it is substantially perpendicular to side panel 34 and against inner panel 42. Outer panel 46 is then folded upwardly along portion 28*b* of fold line 28 so that inner panel 44 is sandwiched between inner panel 42 and outer panel 46. In this folded condition, openings 66 in panels 42 and 44 are substantially aligned with opening 91 in outer panel 46 to define a hand hole for grasping the other end of the box. Panels 42, 44 and 46 are held in this assembled condition by folding flap 82 over the aligned tabs 62 and recesses 64 of panels 42 and 44. When so folded, the aligned tabs 62 project through the openings (not shown) formed by H-shaped slits 84, and the strips 86 reside in the aligned recesses 64 to lock the end panels together.

Figure 6:
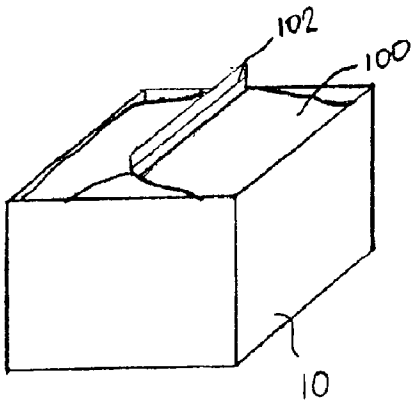
FIG. 6 is a perspective view of the filled box of FIG. 5 with the inner bag sealed closed.
Figure 5:
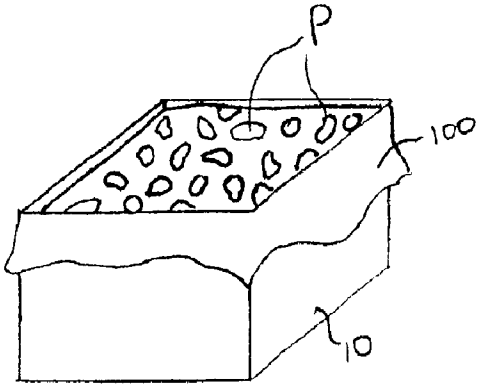
FIG. 5 is a perspective view of the box of FIG. 4 filled with pickles and brine.

Once box 10 has been formed from blank 20, it may be lined with a liner, desirably moisture impervious, to protect the pickles and brine solution from contaminants and to prevent the brine solution from leaking. A preferred liner is plastic bag 100, as shown in FIG. 4, although a molded plastic liner or other leak-resistant liner may be used. Referring to FIG. 5, the cured pickles P may be removed from their storage barrels and packed in boxes 10 to a level just below the upper edge of the boxes. Brine solution may be added to the box to a level substantially covering all of the pickles, after which bag 100 may be sealed closed, as shown in FIG. 6. Although it is contemplated that bag 100 may be closed by any conventional method, including knotting the open end of the bag, or closing the open end of the bag with a twist tie, cable tie, string, clamp or the like, a particularly preferred technique is to apply a heat seal 102 to close the open end of the bag. Such techniques are preferred because they are fast, neat and because they seal the bag closed, thereby preventing loss of the brine solution through leakage or evaporation.

After bag 100 has been closed, the open top of box 10 may be closed. Box 10 may be of the type having a plurality of flaps foldably connected to the upper edges of the side and end panels of the box, and may be closed by folding these flaps over the top of the box into interengagement with one another. Alternatively, a lid may be provided to enclose the open top of box 10. Although it will be appreciated that blank 20 may include an integrally formed portion foldable into a lid, the use of a separate lid is preferred since it may be removed entirely from box 10 so as to not interfere with the filling of the box with pickles or the removal of pickles from the box for use.

Figure 2:
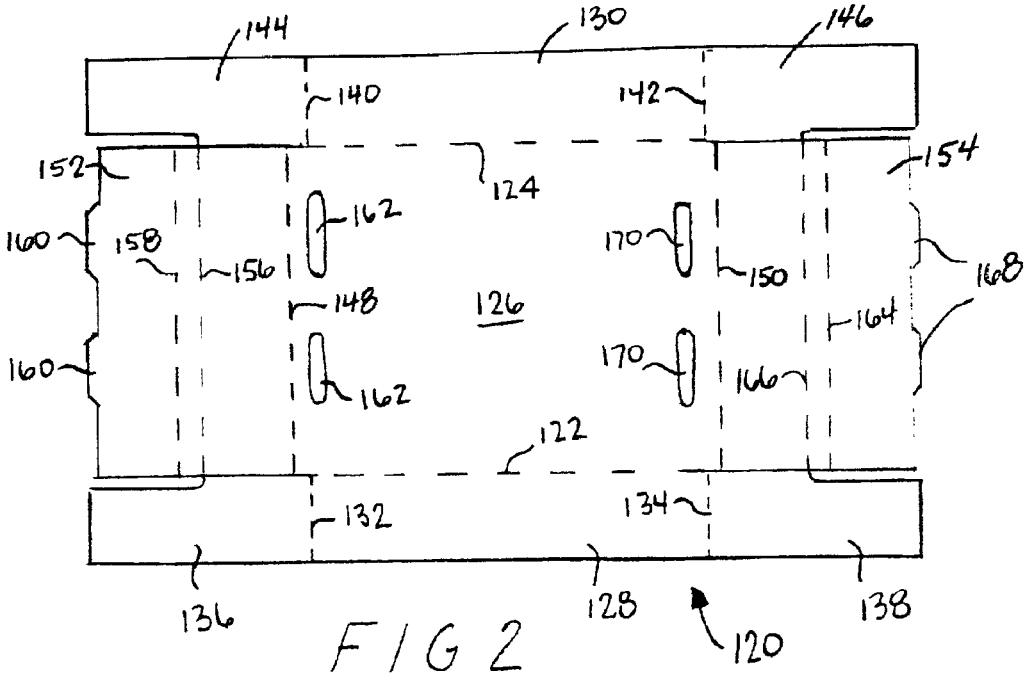
FIG. 2 is a plan view of a blank for forming a top for the box.
Figure 3:
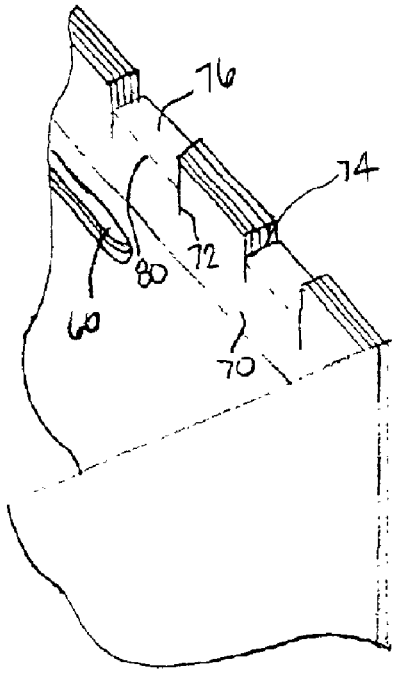
FIG. 3 is an enlarged partial view showing the end of the box in an assembled condition.

A blank 120 for forming a separate lid 110 is shown in FIG. 2. Blank 120 is preferably formed from a heavy duty corrugated cardboard, and preferably the same heavy duty, wax impregnated corrugated cardboard from which blank 20 is formed. Longitudinal fold lines 122 and 124 divide blank 120 into a top panel 126 and side panels 128 and 130. Each side panel includes a pair of fold lines for defining inner end panels of lid 110. Thus, side panel 128 includes fold lines 132 and 134 defining inner end panels 136 and 138, respectively, and side panel 130 includes fold lines 140 and 142 for defining inner end panels 144 and 146, respectively. Blank 120 also includes a pair of transverse fold lines 148 and 150 for defining respective end wall members 152 and 154 foldably connected to top panel 126.

To form lid 110, side panels 128 and 130 are folded upwardly along fold lines 122 and 124, respectively, until they are substantially perpendicular to top panel 126. End panel 136 is then folded inwardly along fold line 132 until it is substantially perpendicular to side panel 128, and end panel 144 is folded inwardly along fold line 140 until it is substantially perpendicular to side panel 130. Subsequently, end wall member 152 is folded upwardly adjacent the outer surfaces of end panels 136 and 144 along transverse fold line 148, and then downwardly adjacent the inner surfaces of end panels 136 and 144 along intermediate fold lines 156 and 158. End wall member 152 is held in this folded position by inserting tabs 160 into respective elongated slots 162 formed in top panel 126.

The opposite end of blank 120 is folded in a similar fashion. Thus, end panel 138 is folded inwardly along fold line 134 until it is substantially perpendicular to side panel 128, and end panel 146 is folded inwardly along fold line 142 until it is substantially perpendicular to side panel 130. End wall member 154 is then folded upwardly adjacent the outer surfaces of end panels 138 and 146 along tranverse fold line 150, and then downwardly adjacent the inner surfaces of end panels 138 and 146 along intermediate fold lines 164 and 166. End wall member 154 is held in this folded condition by inserting tabs 168 into respective elongated slots 170 formed in the top panel 126.

Figure 7:
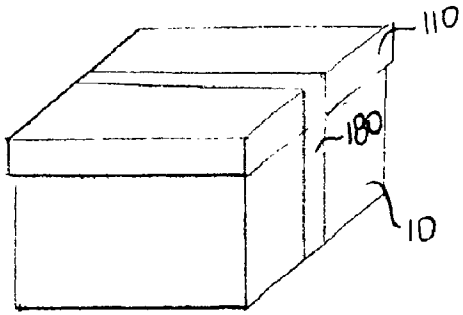
FIG. 7 is a perspective view of the filled box of FIG. 6 closed for shipping.

One or more straps 180 may be applied tightly around box 10 in the lengthwise and/or widthwise directions to hold the box in the closed condition and to assume some of the outward stress exerted on the box by the pickles and brine solution packed inside. An example of a closed box 10 ready for shipment is illustrated in FIG. 7.

Figure 8:
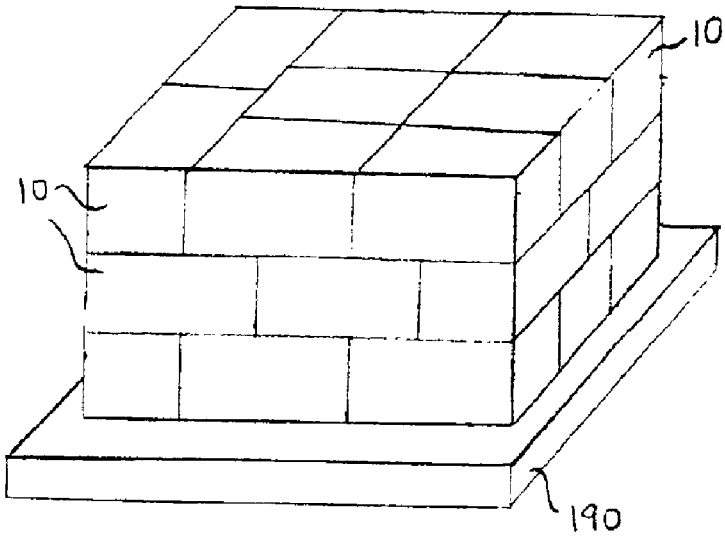
FIG. 8 is a schematic perspective view showing a plurality of the boxes of FIG. 7 arranged on a pallet.

The rectangular shape of box 10 makes it easy to assemble a plurality of these boxes on a standard pallet for shipment. FIG. 8 schematically shows one arrangement in which twenty-four boxes 10 have been assembled on a pallet 190 in three layers. Pallet 190 occupies about the same amount of area as nine of the open-topped ten-gallon pails used in the prior art. Therefore, the use of the boxes 10 of the present invention enables about 240 gallons of pickles to be shipped in the same amount of floor space as had been previously used to ship about 90 gallons of pickles.

It will be appreciated that box 10 may be formed with dimensions for holding volumes of pickles other than ten gallons. For example, box 10 may be formed with smaller dimensions for holding about five gallons of pickles, and thus may serve as a replacement for the five-gallon plastic tubs presently in use. These five-gallon boxes provide all of the same advantages provided by the ten-gallon boxes described above. In addition, the five-gallon boxes may be made with a height which is much lower than height of the standard five-gallon tubs. This ability enables a greater number of five-gallon units to be held on a conventional storage shelf. That is, a conventional storage shelf can hold a pallet containing thirty-six of the five-gallon tubs stacked in three layers of twelve tubs each, for a total of 180 gallons of pickles. In contrast, when the five-gallon boxes are formed with a squat profile, a conventional storage shelf can hold a pallet containing fifty of such boxes stacked in five layers of ten boxes each, for a total of 250 gallons of pickles. This capability provides advantages to distributors since each of their storage shelves would be able to store fifty five-gallon units of pickles rather than the thirty-six units they were previously able to store, thus increasing storage capacity and enabling a greater number of "picks" from a pallet before it must be replaced. Yet a further advantage is that the five-gallon boxes have a hand hole on each end, making them easier to handle than the five-gallon tubs which typically have only a single handle.

In an alternate embodiment of the present invention, the cucumbers may be packed directly in box 10 after the washing step and substantially covered with a brine solution. The bag 100 and box 10 may then be closed as described above and the boxes assembled on a pallet. In accordance with this method, the cucumbers will cure to a pickled state during the time they are in transit from the manufacturer, through any distributor, to the end user.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A method for manufacturing pickled products, comprising providing stock for pickling;

providing a cardboard box having a plurality of sides, a bottom and an open top;

lining said cardboard box with a liner having an open top;

placing a selected quantity of said stock in said liner;

filling said liner with a pickling solution to a level which substantially covers said stock;

closing said open top of said liner;

enclosing said open top of said box; and maintaining said stock in said pickling solution for a time sufficient for said stock to cure to a pickled state.

2. The method as claimed in claim 1, further comprising shipping said enclosed box, whereby said stock cures to said pickled state during said shipment.

3. The method as claimed in claim 2, further comprising stacking a plurality of said enclosed boxes on a pallet prior to said shipping step.

4. The method as claimed in claim 3, wherein said enclosed boxes are stacked on said pallet in at least two layers.

5. The method as claimed in claim 1, wherein said cardboard box is formed from a wax-impregnated cardboard.

6. The method as claimed in claim 1, wherein said liner comprises a plastic bag having an open top.

7. The method as claimed in claim 6, wherein said open top of said bag is closed by heat-sealing.

8. The method as claimed in claim 1, wherein said step of enclosing said open top of said box comprises providing a lid for said box and assembling said lid over said open top of said box.

9. The method as claimed in claim 1, wherein said box has a volume sufficient to hold about ten gallons of said stock.

10. The method as claimed in claim 1, wherein said cardboard box has a substantially rectangular profile.

11. The method as claimed in claim 1, wherein said pickling solution comprises a brine solution.

12. A method of packaging pickled products, comprising providing a cardboard box having a plurality of sides, a bottom and an open top;

lining said cardboard box with a liner having an open top;

placing a selected quantity of said pickled products in said liner;

filling said liner with a liquid to a level which substantially covers said plurality of pickled products;

closing said open top of said liner; and enclosing said open top of said box.

13. The method as claimed in claim 12, wherein said cardboard box is formed from a wax-impregnated cardboard.

14. The method as claimed in claim 12, wherein said liner comprises a plastic bag having an open top.

15. The method as claimed in claim 14, wherein said open top of said bag is closed by heat sealing.

16. The method as claimed in claim 12, wherein said box has a volume sufficient to hold about 10 gallons of said pickled products.

17. The method as claimed in claim 12, wherein said liquid comprises a brine solution.

* * * * *